US005674091A

United States Patent [19]

Saitoh et al.

[11] Patent Number: 5,674,091

[45] Date of Patent: Oct. 7, 1997

[54] CONNECTOR INCLUDING A TERMINAL INSERTION DETECTING MEMBER

[75] Inventors: Hitoshi Saitoh; Kazuto Ohtaka, both of Shizuoka, Japan

[73] Assignee: Yazaki Corporation, Tokyo, Japan

[21] Appl. No.: 583,840

[22] Filed: Jan. 11, 1996

[30] Foreign Application Priority Data

Jan. 18, 1995 [JP] Japan ..... 7-005939

[51] Int. Cl.[6] ..... H01R 13/422

[52] U.S. Cl. ..... 439/595

[58] Field of Search ..... 439/595, 752, 439/744

[56] References Cited

U.S. PATENT DOCUMENTS

| | | | |
|---|---|---|---|
| 4,557,542 | 12/1985 | Coller et al. | 439/595 |
| 4,950,182 | 8/1990 | Zielinski et al. | 439/595 |
| 4,986,758 | 1/1991 | Wakata | 439/595 |
| 5,108,310 | 4/1992 | Sawada et al. | 439/595 |
| 5,127,854 | 7/1992 | Fujitani et al. | 439/595 |
| 5,529,515 | 6/1996 | Ohtaka et al. | 439/595 |

*Primary Examiner*—Neil Abrams
*Attorney, Agent, or Firm*—Sughrue, Mion, Zinn, Macpeak, and Seas

[57] ABSTRACT

There is disclosed a connector in which there is no need to provide any separate or additional retaining arm, and a detection member (33) can be provisionally retained, and the construction of the connector is simplified, and the detection member is prevented from being lost. A fitting hole (31) in communication with a refuge space 29 for a terminal retaining piece portion (27) is formed in a connector housing, and is open to a front end face thereof. There is provided the detection member for being inserted into the fitting hole, and the detection member has an insertion plate (35*a*, 35*b*) for being inserted into the refuge space. The insertion plate has an insertion guide surface (43) for guiding the insertion of a mating connector terminal, (53) and a cantilever-like, elastic retaining arm, (45) having the guide surface at its free end, is formed at the insertion plate. A provisionally-retaining convex portion (41) is formed on the connector housing, and a provisionally-retaining projection (39) is formed on the insertion plate. In a retracted condition of the detection member in which the insertion plate is disposed out of the refuge space, the provisionally-retaining projection is retainingly engaged with the provisionally-retaining convex portion, thereby preventing the detection member from being withdrawn from the fitting hole.

6 Claims, 6 Drawing Sheets

CONNECTOR INCLUDING A TERMINAL INSERTION DETECTING MEMBER

BACKGROUND OF THE INVENTION

1. Field of the Invention

This invention relates to a connector in which flexure of each terminal retaining piece portion is limited to thereby prevent disengagement of a terminal, and besides there is provided a detection member for detecting a half-inserted condition of the terminal.

2. Background

Generally, in a small-size connector used, for example, for wiring in a vehicle, a terminal, inserted in a terminal receiving chamber in a connector housing, is retained by an elastic terminal retaining piece portion formed integrally with the connector housing, thereby preventing the terminal from being withdrawn from the terminal receiving chamber.

One such connector, in which flexure of a terminal retaining piece portion is further limited after the terminal is attached, thereby preventing withdrawal of the terminal in a double manner, and besides there is provided a detection member for detecting a half-inserted condition of the terminal, will now be described with reference to FIG. 12.

FIG. 12 is a cross-sectional view of the conventional connector with the detection member.

Terminal receiving chambers 3 are formed in a connector housing 1, and terminals 7 each having a wire 5 fixedly connected thereto are received in the terminal receiving chambers 3, respectively. The terminal receiving chamber 3 has a cantilever-like, elastic retaining piece portion (terminal retaining piece portion) 9 formed integrally on an inner surface thereof, and a retaining portion 9*a* of the terminal retaining piece portion 9, projected into the terminal receiving chamber 3, retainingly engages the terminal 7, thereby preventing the terminal 7 from being withdrawn from the terminal receiving chamber 3. A refuge space 11 for receiving the terminal retaining piece portion 9 when this piece portion 9 is elastically displaced is provided at the back side of the terminal retaining piece portion 9, and the refuge space 11 communicates with a fitting hole 13 open to a front end face of the connector housing 1.

A detection member 15 can be fitted in the fitting hole 13, and when the detection member 15 is fitted in the fitting hole 13, a wedge-like projection 15*a* of the detection member 15 is inserted into the refuge space 11. The detection member 15 has insertion openings 17 each communicated with the associated terminal receiving chamber 3, and the insertion opening 17 serves as an inlet for a mating connector terminal (not shown). A chamfered portion 19 is formed at the insertion opening 17, and serves as a guide surface for the mating connector terminal so as to facilitate the insertion of the mating connector terminal. The detection member 15 has a retaining arm (not shown) formed, for example, on a side surface of the detection member 15, and this retaining arm engages a retaining portion (not shown) on the connector housing 1 to retain the detection member 15 relative to the connector housing 1.

In the conventional connector of this construction, when the detection member 15 is fitted in the fitting hole 13 after the terminal is attached, the wedge-like projection 15*a* is inserted into the refuge space 11 to prevent the terminal retaining piece portion 9 from being flexed into the refuge space 11, so that the terminal retaining piece portion 9 positively retains the terminal 7. When the terminal 7 is in a half-inserted condition, the retaining engagement of the terminal retaining piece portion 9 with the terminal 7 is incomplete, and the terminal retaining piece portion 9 is kept projected into the refuge space 11, and the terminal retaining piece portion 9 thus projected prevents the insertion of the wedge-like projection 15*a*, thus disenabling the insertion of the detection member 15, so that the half-inserted condition of the terminal 7 is detected.

In the conventional connector with the detection member, however, the retaining arm (for example, cantilever-like elastic retaining piece portion like the terminal retaining piece portion 9) for retaining the detection member 15 relative to the connector housing 1 must be additionally formed, for example, on the side surface thereof. This makes the construction complicated, and prevents a compact design.

SUMMARY OF THE INVENTION

With the above problems in view, it is an object of this invention to provide a connector in which there is no need to provide any separate or additional retaining arm, thereby simplifying the construction of a detection member so as to achieve a compact design of the connector.

The above object has been achieved by a connector of the invention wherein a cantilever-like, elastic retaining piece portion (terminal retaining piece portion) for retaining a terminal is provided within a terminal receiving chamber in a projected manner; the connector includes a refuge space for receiving the terminal retaining piece portion when the retaining is released is provided at a back side of the terminal retaining piece portion; a fitting hole in communication with the refuge space is formed in a connector housing, and is open to a front end face of the connector housing; there is provided a detection member for being inserted into the fitting hole; the detection member has an insertion plate which is inserted into the refuge space when the detection member is completely inserted into the fitting hole; an insertion guide surface for guiding the insertion of a mating connector terminal is formed on the insertion plate; the insertion plate is notched to provide a cantilever-like, elastic retaining arm having the guide surface formed on a free end thereof; a completely-retaining convex portion is formed on the connector housing; and the retaining arm has a completely-retaining projection which is retainingly engaged with the completely-retaining convex portion when the detection member is completely inserted into the fitting hole.

Preferably, a provisionally-retaining convex portion is formed on the connector housing, and a provisionally-retaining projection is formed on the insertion plate, and in a retracted condition of the detection member in which the insertion plate is disposed out of the refuge space, the provisionally-retaining projection is retainingly engaged with the provisionally-retaining convex portion, thereby preventing the detection member from being withdrawn from the fitting hole.

When the detection member is inserted into the fitting hole after the terminal is mounted in the terminal receiving chamber, the retaining arm is flexed, and the completely-retaining projection retainingly engages the completely-retaining convex portion, so that the detection member is completely retained in the fitting hole. In this condition, the front end portion of the insertion plate is received in the refuge space to prevent the flexing of the terminal retaining piece portion into the refuge space, thereby preventing the terminal retaining piece portion from being disengaged from the terminal, thus positively maintaining the retaining engagement of the terminal retaining piece portion with the terminal.

If the terminal is incompletely inserted into the terminal receiving chamber, the terminal retaining piece portion is kept received in the refuge space, and therefore the insertion of the insertion plate is prevented by the terminal retaining piece portion, and the half-inserted condition of the terminal is detected.

When it becomes necessary to exchange the terminal, for example, because of wrong attachment of the terminals, the retaining arm is flexed in a direction to disengage the completely-retaining projection from the completely-retaining convex portion, thus releasing the retaining engagement therebetween, so that the detection member can be pulled back relative to the fitting hole. Then, the detection member is pulled back into the provisionally-retained condition, so that the insertion plate is moved out of the refuge space. As a result, the terminal retaining piece portion can be flexed, and therefore the exchange of the terminals can be effected. Even in this condition, the provisionally-retaining projection of the detection member is retainingly engaged with the provisionally-retaining convex portion, thereby preventing the detection member from being disengaged from the connector housing.

The retaining arm, which achieves the above effects, can be formed merely by notching the insertion plate, and any additional retaining device does not need to be provided.

DESCRIPTION OF THE PREFERRED EMBODIMENTS OF THE INVENTION

A preferred embodiment of a connector of the present invention will now be described with reference to the drawings.

Figure 1:
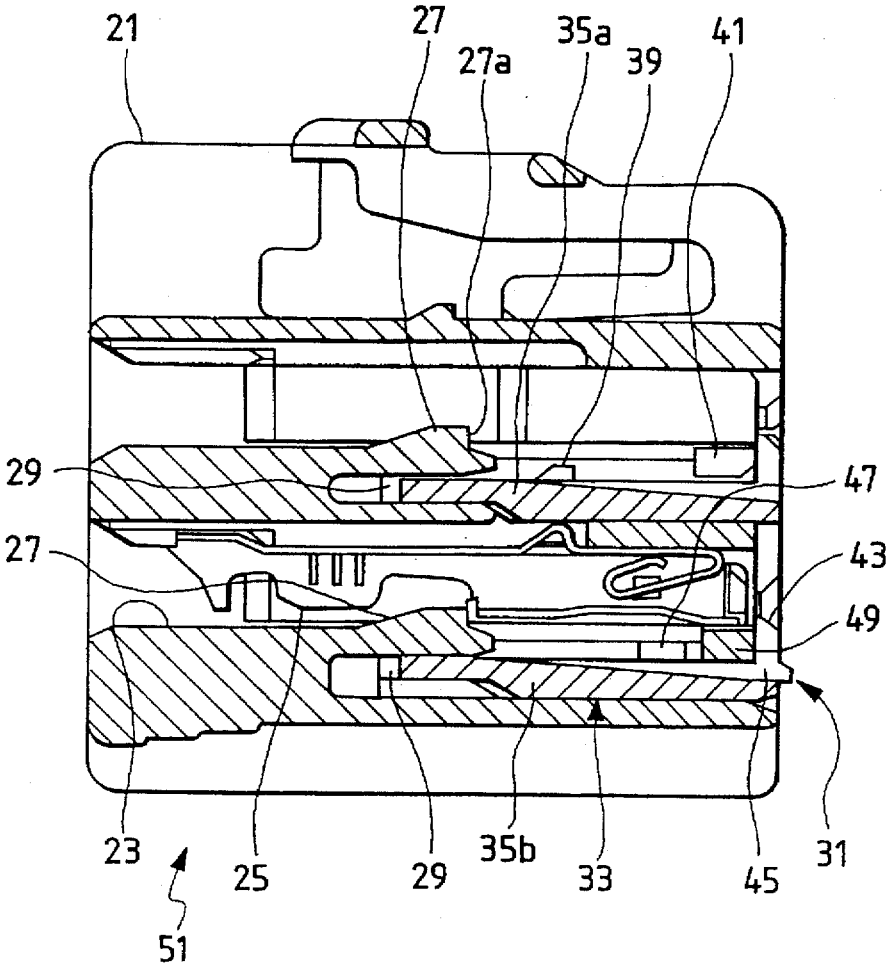
FIG. 1 is a cross-sectional view of a connector of the present invention.
Figure 2:
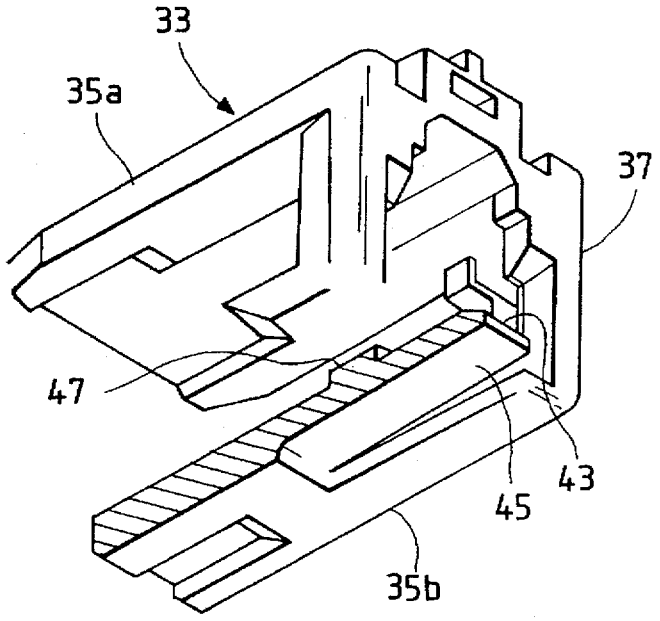
FIG. 2 is a partly-broken, perspective view of a detection member used in the connector of the invention.
Figure 3:
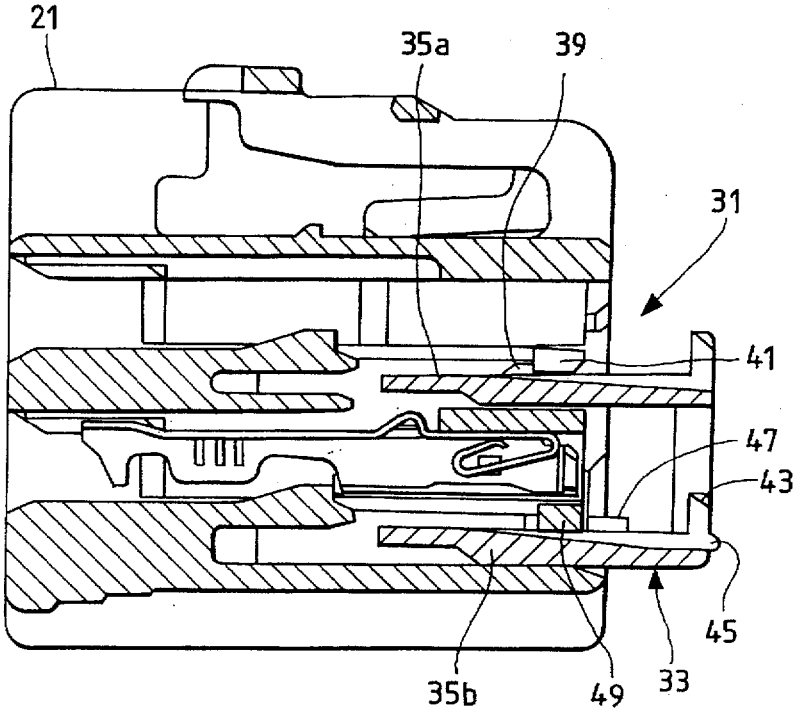
FIG. 3 is a cross-sectional view of the connector showing the detection member as held in its provisionally-retained condition.

FIG. 1 is a cross-sectional view of the connector of the invention, FIG. 2 is a partly-broken, perspective view of a detection member used in the connector of the invention, and FIG. 3 is a cross-sectional view of the connector showing the detection member as held in its provisionally-retained condition.

Terminal receiving chambers 23 are formed in a connector housing 21, and terminals 25 are received in the terminal receiving chambers 23, respectively. The terminal receiving chamber 23 has a cantilever-like, elastic retaining piece portion (terminal retaining piece portion) 27 formed integrally on an inner surface thereof. The terminal retaining piece portion 27 has a retaining portion 27a which projects into the terminal receiving chamber 23 to retainingly engage the terminal 25, thereby preventing the terminal 25 from being withdrawn from the terminal receiving chamber 23. A refuge space 29 for receiving the terminal retaining piece portion 27 when this piece portion 27 is elastically displaced is provided at the back side of the terminal retaining piece portion 27, and the refuge space 29 communicates with a fitting hole 31 open to a front end face of the connector housing 21.

A detection member (hereinafter referred to as "front holder") 33 is fitted in the fitting hole 31. The front holder 33 of a generally U-shape includes upper and lower horizontal insertion plates **35*a* and 35*b* interconnected at their one ends by a vertical insertion opening frame 37, as best shown in FIG. 2. A provisionally-retaining projection 39 (FIG. 1) is formed on an upper surface of the upper insertion plate 35*a*, and when the front holder 33 is pulled back relative to the fitting hole 31, the provisionally-retaining projection 39 is retainingly engaged with a provisionally-retaining convex portion 41 (FIG. 3) formed adjacent to a front end face of the connector housing 21, thereby preventing the front holder 33 from being withdrawn from the fitting hole 31. When the front holder 33 is completely fitted in the fitting hole 31 (see FIG. 1), the provisionally-retaining projection 39 is kept spaced from the provisionally-retaining convex portion 41. Namely, the front holder 33 can be pulled back relative to the fitting hole 31 by a distance corresponding to this spacing, as shown in FIG. 3. This condition is a provisionally-retained condition of the front holder 33**.

Guide surfaces 43 each defined by a chamfered portion are provided at the insertion opening frame 37, and the guide surfaces 43 facilitate the insertion of mating connector terminals. Part of the lower insertion plate **35*b* is notched to provide a cantilever-like, elastic retaining piece portion (retaining arm) 45 having the guide surface 43, and a free end of the retaining arm 45 having the guide surface 43 is displaceable. A completely-retaining projection 47 is formed on an upper surface of the retaining arm 45, and when the front holder 33 is completely fitted in the fitting hole 31, the completely-retaining projection 47 slides over a completely-retaining convex portion 49, formed adjacent to the front end face of the connector housing 21, and is retainingly engaged with this completely-retaining convex portion 49. When the completely-retaining projection 47 is retained by the completely-retaining convex portion 49, the front holder 33 is completely retained relative to the connector housing 21. In this condition, the upper and lower insertion plates 35*a* and 35*b* of the front holder 33 are received or inserted at their front end portions in the refuge spaces 29, respectively, as shown in FIG. 1**.

The operation of the connector 51 of the above construction in this embodiment will now be described.

When the terminal 25 is inserted into the terminal receiving chamber 23, the terminal retaining piece portion 27 is elastically displaced into the refuge space 29, and upon complete insertion of the terminal 25, the terminal retaining piece portion 27 comes out of the refuge space 29 to retainingly engage a rear end surface of the terminal 25. In this condition, the terminal retaining piece portion 27 is not projected into the refuge space 29.

When the front holder 33 is inserted into the fitting hole 31 before the terminal 25 is inserted into the terminal receiving chamber 23, the provisionally-retaining projection 39 of the front holder 33 first abuts against the provisionally-retaining convex portion 41. In this condition, when the front holder 33 is further pushed, the provisionally-retaining projection 39 slides over the provisionally-retaining convex portion 41, so that the front holder 33 is brought into the provisionally-retained condition. In this condition, the front end portions of the upper and lower insertion plates 35*a* and 35*b* of the front holder 33 are not inserted in the refuge spaces 29, respectively. Namely, the terminal retaining piece portions 27 can still be flexed.

In this provisionally-retained condition of the front holder 33, the terminals 25 are inserted into the respective terminal receiving chambers 23 as described above.

When the front holder 33 is further inserted, the completely-retaining projection 47 abuts against the completely-retaining convex portion 49 on the connector housing 21 (see FIG. 3). In this condition, when the front holder 33 is further pushed, the retaining arm 45 is flexed, and the completely-retaining projection 47 slides over the completely-retaining convex portion 49, so that the front holder 33 is completely retained relative to the fitting hole 31 (see FIG. 1). In this condition, the front end portions of the upper and lower insertion plates 35*a* and 35*b* are received respectively in the refuge spaces 29, thereby preventing the terminal retaining piece portions 27 from being flexed into the respective refuge spaces 29. The terminal retaining piece portion 27 is thus prevented from being flexed, and therefore the terminal retaining piece portion 27 is prevented from being disengaged from the terminal 25, so that the terminal retaining piece portion 27 positively retains the terminal 25.

If the terminal 25 is incompletely inserted into the terminal receiving chamber 23, the retaining engagement of the terminal retaining piece portion 27 with the terminal 25 is incomplete, so that the terminal retaining piece portion 27 is kept received in the refuge space 29. As a result, the insertion of the upper and lower insertion plates 35*a* and 35*b* is prevented by the terminal retaining piece portion 27, so that the half-inserted condition of the terminal 25 can be detected.

For example, when the terminal 25 is to be exchanged, the retaining arm 45 is flexed to move the completely-retaining projection 47 away from the completely-retaining convex portion 49. As a result, the retaining engagement of the completely-retaining projection 47 with the completely-retaining convex portion 49 is released, thus enabling the front holder 33 to be withdrawn from the fitting hole 31. When the front holder 33 is withdrawn into the provisionally-retained condition, the front end portions of the upper and lower insertion plates 35*a* and 35*b* are withdrawn respectively from the refuge spaces 29, thus enabling the flexing of the terminal retaining piece portions 27, so that the terminal 25 can be withdrawn from the terminal receiving chamber 23. Even in this condition, the provisionally-retaining projection 39 of the front holder 33 is provisionally-retained relative to the provisionally-retaining convex portion 41 (see FIG. 3), thus preventing the front holder 33 from being disengaged from the connector housing 21.

In the above connector 51, the retaining arm 45, which holds the front holder 33 on the connector housing 21, is formed by notching part of the lower insertion plate 35*b*, and therefore any additional retaining device serving only as such a retaining arm does not need to be provided. This enables the front holder 33 to be simplified in construction. And besides, the front holder can be provisionally retained on the connector housing 21, and therefore for exchanging the terminals, the retaining arm 45 is flexed, and the retaining engagement by the terminal retaining piece portion 27 is released in a retracted condition of the front holder. Thus, the front holder 33 is not separated from the connector housing 21, and hence will not be lost.

In the above connector 51, the retaining arm 45 is formed by notching a part of the front holder 33, and with this arrangement the simplified construction (which is the object of the invention) as well as the provisionally-retaining construction is achieved.

Figure 4:
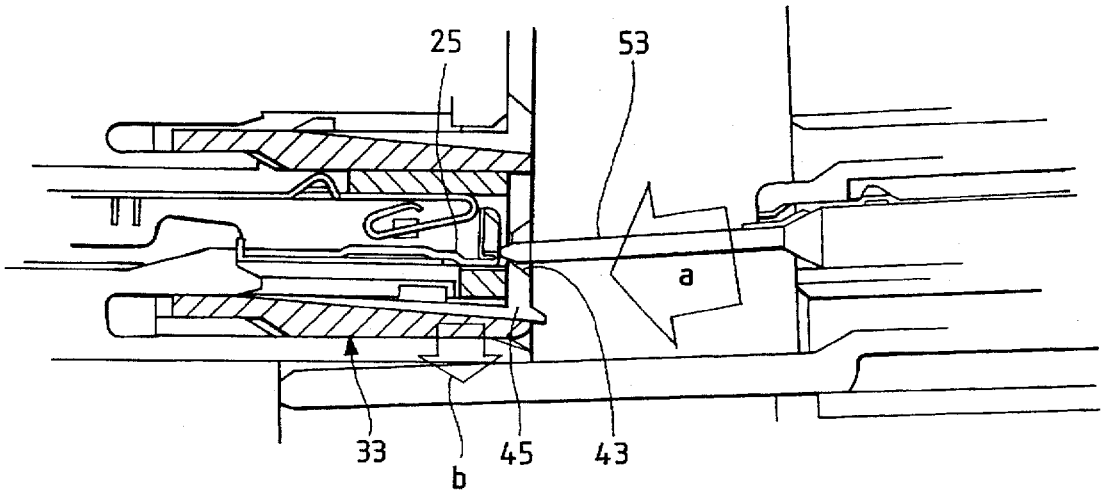
FIG. 4 is a view showing a condition when a mating connector terminal is advancing in a direction to release the completely-retained condition of the front holder.

However, in the above connector 51, the retaining arm 45 is defined by the cantilever-like, elastic retaining piece portion having the guide surface 43, and this may invite another problem. More specifically, the retaining arm 45 is mostly separated from the lower insertion plate 35*b*, and has the guide surface 43 at its front end, and therefore when the mating connector terminal 53 is advancing in a direction (direction of arrow a) as shown in FIG. 4, the guide surface 43 maybe urged downwardly (in a direction of arrow b) by the mating connector terminal 35, and the front end of the mating connector terminal 53 may interfere with the front end surface of the terminal 25, so that the front ends of the two terminals may be damaged.

A second embodiment of a connector of the invention, which overcomes this disadvantage caused by the movement of the retaining arm during the connector fitting operation, will now be described with reference to FIGS. 5 to 8.

Figure 5:
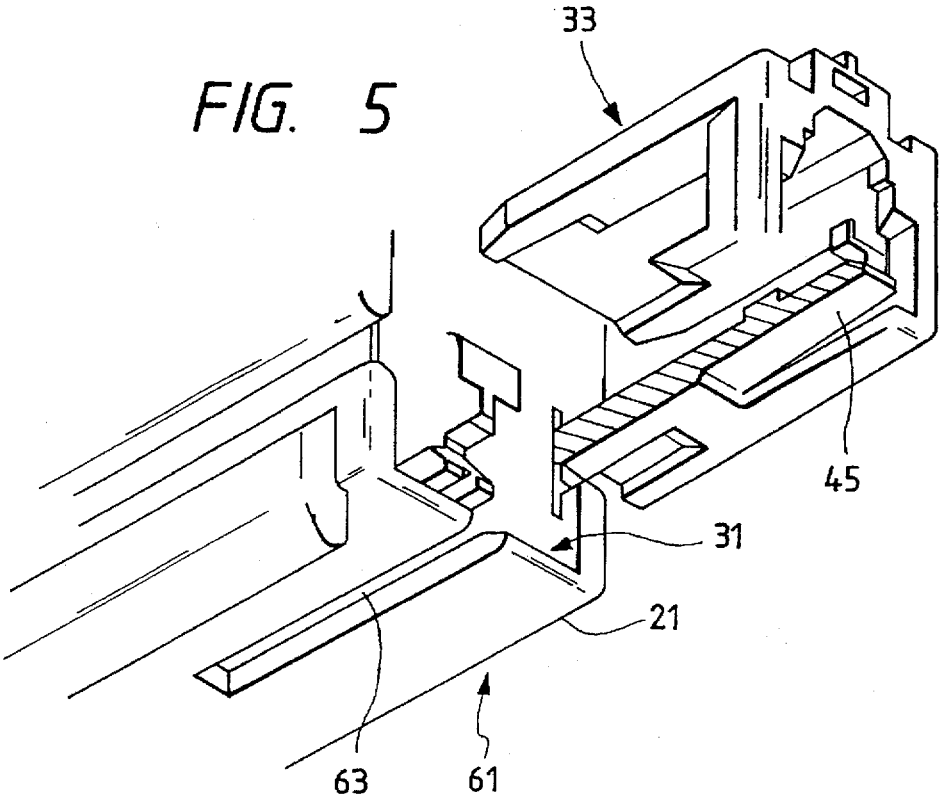
FIG. 5 is an exploded, perspective view of an important portion of a connector according to a second embodiment.
Figure 6:
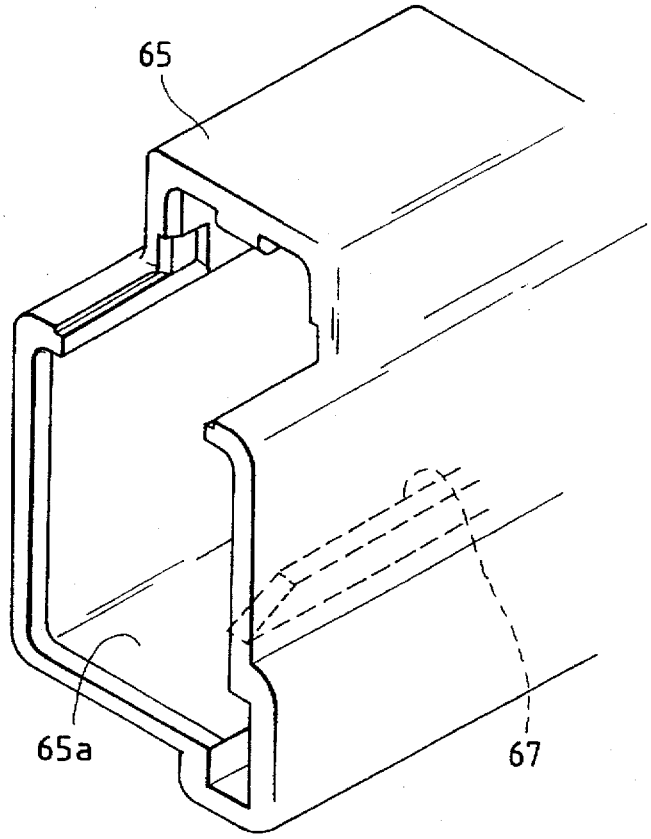
FIG. 6 is a perspective view of a mating connector housing.
Figure 7:
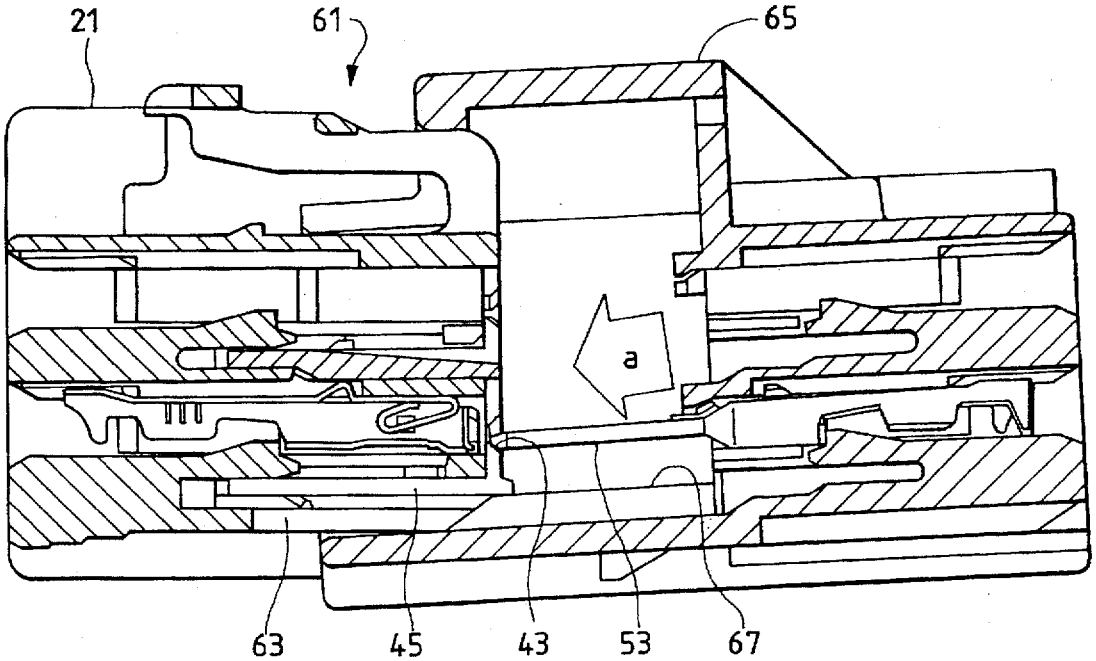
FIG. 7 is a cross-sectional view showing an initial stage of a fitting operation of the connector of the second embodiment.
Figure 8:
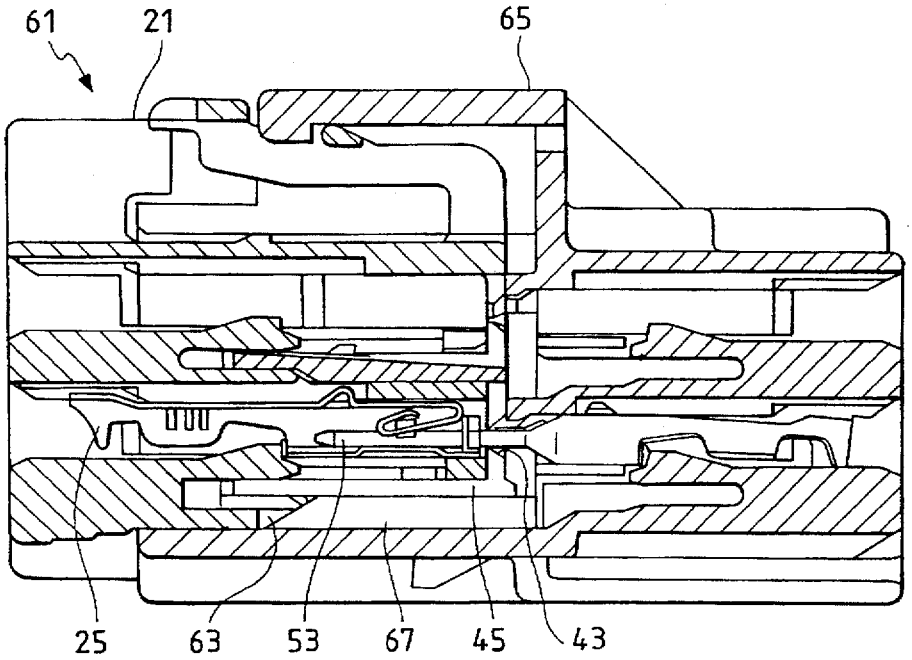
FIG. 8 is a cross-sectional view showing a condition in which the fitting operation of the connector of the second embodiment is completed.

FIG. 5 is an exploded, perspective view showing an important portion of the connector of the second embodiment, FIG. 6 is a perspective view of a mating connector housing, FIG. 7 is a cross-sectional view showing an initial stage of a fitting operation of the connector of the second embodiment, and FIG. 8 is a cross-sectional view showing a condition in which the fitting operation of the connector of the second embodiment is completed.

In the connector 61 of this embodiment, a connector housing 21 has a slit 63 extending from an edge of a fitting hole 31, and when a front holder 33 is fitted into the fitting hole 31, the slit 63 is disposed in registry with a back surface of a retaining arm 45. Through the slit 63, the back surface of retaining arm 45 is exposed to the outside of the connector housing 21.

A rail-like rib 67 is formed on an inner surface 65*a* of the mating connector housing 65 (see FIG. 6) adapted to be fitted on the connector housing 21, and when the connector housing 21 and the mating connector housing 65 are fitted together, the rib 67 is received in the slit 63, and is held in contact with the back surface of the retaining arm 45. The rib 67 extends forwardly beyond a front end of a mating connector terminal 53, and before the mating connector terminal 53 contacts a guide surface 43 of the front holder 33, the rib 67 is brought into contact with the back surface of the retaining arm 45.

In operation of the connector 61 of this construction, when the mating connector terminal 53 is advancing in a direction (direction of arrow a) as shown in FIG. 7 the rib 67 of the mating connector housing 67 is received in the slit 63 in the connector housing 21, and is brought into contact with the back surface of the retaining arm 45 before the mating connector terminal 53 is brought into contact with the guide surface 43. As a result, the rib 67 prevents the retaining arm 45 from being flexed downwardly. Thereafter, even when the mating connector terminal 35 is brought into contact with the guide surface 43 to urge the same, the guide surface 43 will not be moved, and hence performs its intended function. Then, when the connector housing 21 and the mating connector housing 65 are completely fitted together, the rib 67 is received in the slit 63, and is held in contact with the back surface of the retaining arm 45, as shown in FIG. 8.

In the connector 61 of this embodiment, during the connector fitting operation, the retaining arm 45 is held by the rib 67 before the guide surface 43 is urged to be displaced by the mating connector terminal 53, so that the guide surface 43 is prevented from being displaced. Therefore, the guide surface 43 can positively perform its function, and damage to the terminals is prevented, and the smooth connector fitting operation is ensured.

A third embodiment of a connector of the invention, which overcomes the above-mentioned disadvantage caused by the movement of the retaining arm during the connector fitting operation, will now be described with reference to FIGS. 9 to 11.

Figure 9:
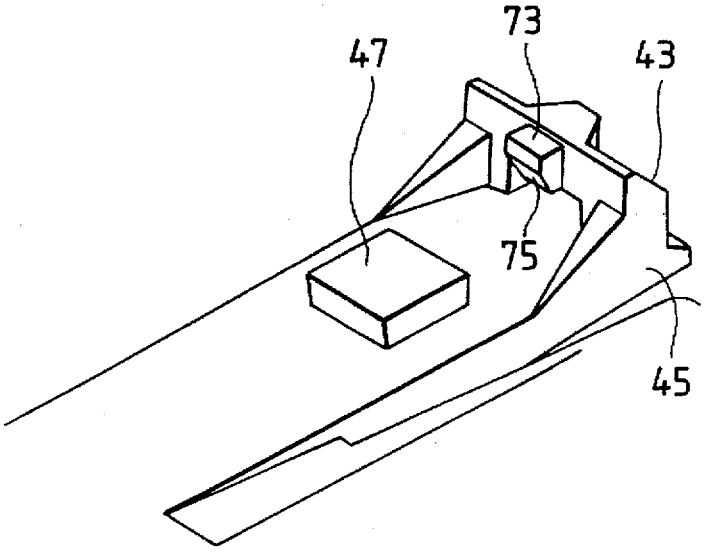
FIG. 9 is an enlarged view of an important portion of a retaining arm used in a connector of a third embodiment.
Figure 10:
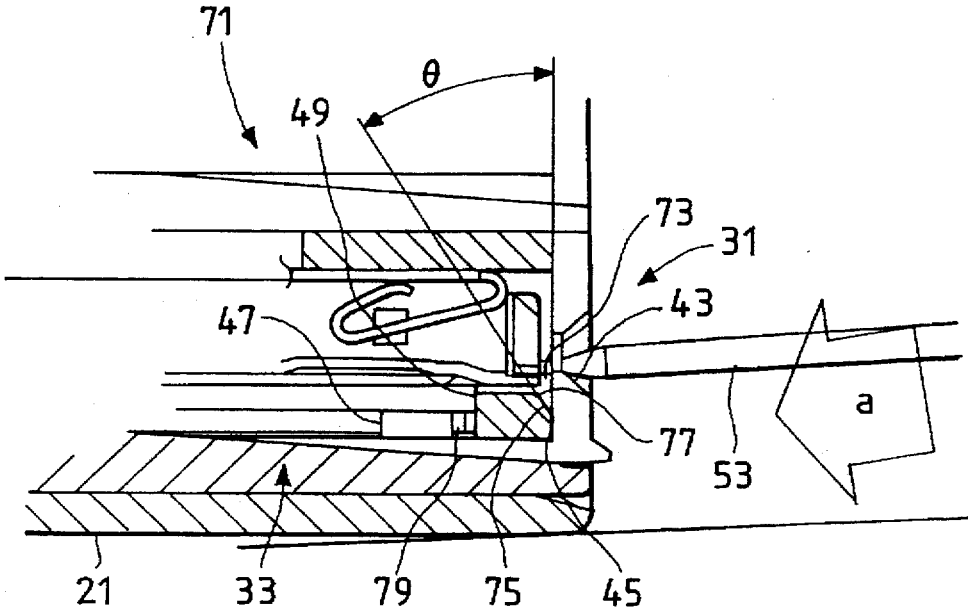
FIG. 10 is a cross-sectional view of the connector of the third embodiment, showing a condition in which a mating connector terminal is to be inserted.
Figure 11:
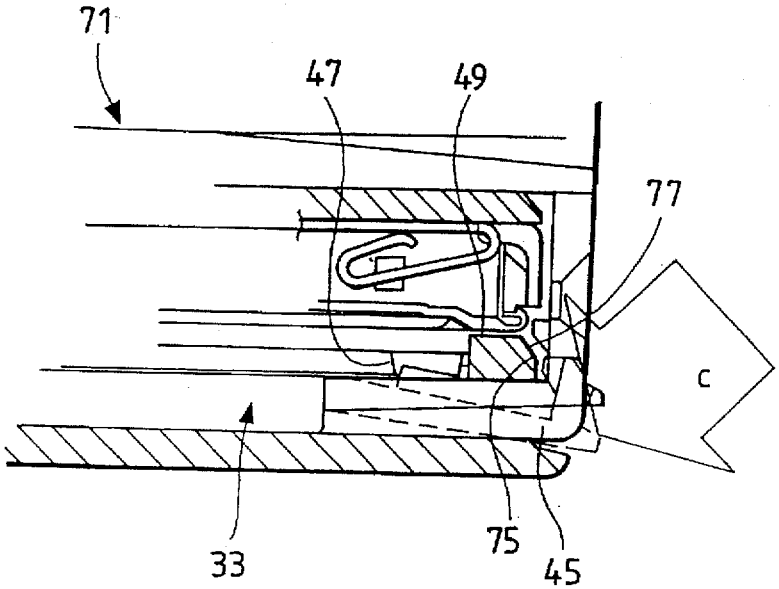
FIG. 11 is a cross-sectional view showing a condition when the retaining of the front holder in the connector of the third embodiment is released.
Figure 12:
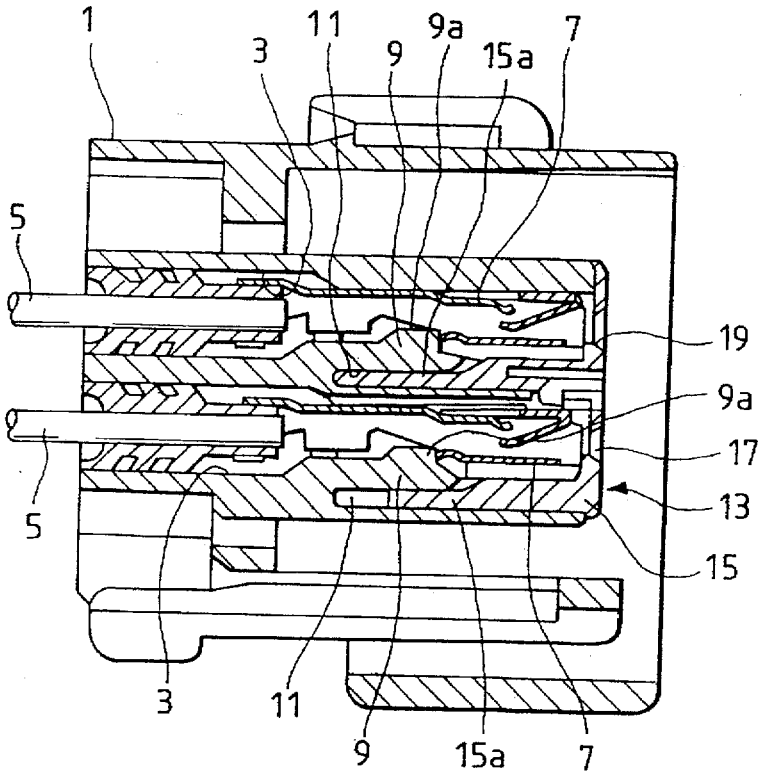
FIG. 12 PRIOR ART
FIG. 12 is a cross-sectional view of a conventional connector provided with a detection member.

FIG. 9 is an enlarged view of an important portion of a retaining arm of a front holder used in the connector of the third embodiment, FIG. 10 is a cross-sectional view of the connector of the third embodiment, showing a condition in which a mating connector terminal is to be inserted, and FIG. 11 is a cross-sectional view showing a condition when the retaining of the front holder in the connector of the third embodiment is released.

In the connector 71 of this embodiment, a projection 73 is formed on a back side of a guide surface 43 of a retaining arm 45. The projection 73 has a slanting surface 75 generally facing the retaining arm 45 at an inclination angle θ (see FIG. 10). An abutment surface 77 is formed on a completely-retaining convex portion 49 of a connector housing 21, and is disposed parallel to the slanting surface 75. When the front holder 33 is completely inserted into a fitting hole 31, the slanting surface 75 is abutted against the abutment surface 77 as shown in FIG. 10.

When the front holder 33 is completely inserted into the fitting hole 31, so that the slanting surface 75 is abutted against the abutment surface 77, a slight gap 79 is formed between the completely-retaining convex portion 49 of the connector housing 21 and a completely-retaining projection 47 of the retaining arm 45, as shown in FIG. 10. Therefore, even in the completely-retained condition, the front holder 33 can be slightly pulled back relative to the fitting hole 31 by a distance corresponding to this gap 79.

In operation of the connector 71 of this construction, when a mating connector terminal 53 is advancing in a direction (direction of arrow a) and abuts against the guide surface 43 as shown in FIG. 10, the slanting surface 75 of the projection 73 of the retaining arm 45 is abutted against the abutment surface 77 of the completely-retaining convex portion 49, thereby preventing the flexing of the retaining arm 45. Therefore, the guide surface 43 will not be moved as in the above second embodiment, and hence will perform its intended function.

For releasing the completely-retained condition of the front holder 33, the front holder 33 is pulled back by a distance corresponding to the gap 79, so that the slanting surface 75 is disengaged from the abutment surface 77, thus avoiding interference therebetween, as shown in FIG. 11. As a result, the retaining arm 45 can be flexed in a direction of arrow c. Subsequently, as described for the above embodiments, the retaining arm 45 is flexed in a direction to disengage the completely-retaining projection 47 from the completely-retaining convex portion 49, thus releasing the retaining engagement between the completely-retaining projection 47 and the completely-retaining convex portion 49, so that the front holder 33 can be pulled back relative to the fitting hole 31 into the provisionally-retained condition.

In the connector 71 of this embodiment, even when the guide surface 43 is pushed or urged by the mating connector terminal 53 during the connector fitting operation, the flexing of the retaining arm 45 is prevented because of the abutment of the slanting surface 75 against the abutment surface 77, thereby preventing the displacement of the guide surface 43. Therefore, the guide surface 43 can positively perform its function, and the smooth connector fitting operation is ensured as in the second embodiment.

In the above embodiments, although the connector has the pair of upper and lower terminal receiving chambers 23, the connector may have terminal receiving chambers 23 arranged in more than two rows (in the horizontal direction) and more than two columns (in the vertical direction), or may have only one terminal receiving chamber 23. Where more than two terminal receiving chambers 23 are provided, the number of insertion plates (35*a*, 35*b* . . . ) is increased in accordance with the number of terminal receiving chambers 23. Where only one terminal receiving chamber 23 is provided, there is provided one insertion plate on which the retaining arm 45 and the provisionally-retaining projection 39 are formed.

As described in detail, in the connectors of the invention, the retaining arm is formed by notching part of the insertion plate, and therefore no additional retaining device serving as the retaining arm does not need to be provided, and therefore the construction of the detection member can be simplified.

By providing the provisionally-retaining projection and the provisionally-retaining convex portion, the detection member can be provisionally retained, and therefore for exchanging the terminals, the retaining arm is flexed, and the retaining engagement by the terminal retaining piece portion is released in the retracted condition of the front holder. Thus, the detection member is not separated from the connector housing, and hence will not be lost.

What is claimed is:

1. A connector, comprising:

a housing having a terminal receiving chamber for receiving a terminal;

a terminal retaining piece formed in the terminal receiving chamber to retain the terminal;

a refuge space formed at a back side of said terminal retaining piece, wherein when said terminal retaining piece is displaced by the terminal, said refuge space receives said terminal retaining piece;

a fitting hole in communication with said refuge space formed in said housing, and opening to a front end face of said housing;

a detection member inserted into said fitting hole;

an insertion plate formed on said detection member, said insertion plate being inserted into said refuge space by inserting said detection member into said fitting hole;

a retaining arm formed to cantilever by notching a part of said insertion plate, said retaining arm having an insertion guide surface for guiding an insertion of a mating terminal formed on a free end thereof;

a completely-retaining portion formed in said housing; and a completely-retaining member formed on said retaining arm, said completely-retaining member being engaged with said completely-retaining portion when said detection member is inserted into said fitting hole.

2. The connector of claim 1, further comprising:

a provisionally-retaining portion formed in said housing; and a provisionally-retaining member formed on said insertion plate, wherein when said insertion plate is disposed out of said refuge space, said provisionally-retaining member is engaged with said provisionally-retaining portion so as to prevent said detection member from being withdrawn from said fitting hole.

3. The connector of claim 1, wherein said housing has a slit through which a back surface of said retaining arm is exposed to the outside of said connector housing, and a rib is formed on an inner surface of a mating housing, and when said housing and said mating housing are fitted together, said rib is received in said slit, and abuts against the back surface of said retaining arm.

4. The connector of claim 1, wherein a projection is formed on a back side of said guide surface, and said completely-retaining portion abuts against said projection when said detection member is completely inserted into said fitting hole.

5. The connector of claim 4, wherein a slanting surface is formed on said projection, and an abutment surface is formed on said completely-retaining portion, said abutment surface being abutted against said slanting surface when said detection member is completely inserted into said fitting hole.

6. The connector of claim 5, wherein a gap is formed between said completely-retaining portion and a completely-retaining member to enable retraction of said detection member by a distance corresponding to said gap after completely inserting said detection member into said fitting hole.

* * * * *